US005921806A

United States Patent [19]

Shuey

[11] Patent Number: 5,921,806

[45] Date of Patent: Jul. 13, 1999

[54] MULTI-EXIT STRAIN RELIEF FOR AN ELECTRICAL CONNECTOR

[75] Inventor: John Raymond Shuey, Mechanicsburg, Pa.

[73] Assignee: The Whitaker Corporation, Wilmington, Del.

[21] Appl. No.: 08/960,650

[22] Filed: Oct. 30, 1997

[51] Int. Cl.[6] ..... H01R 13/58

[52] U.S. Cl. ..... 439/464

[58] Field of Search ..... 439/470, 464, 439/471, 466, 468

[56] References Cited

U.S. PATENT DOCUMENTS 4,944,689 7/1990 Carr ..... 439/470
5,391,092 2/1995 Sumida ..... 439/470

*Primary Examiner*—Steven L. Stephan
*Assistant Examiner*—Javaid Nasri

[57] ABSTRACT

An electrical connector (2) includes terminals (4) positioned in a connector housing (6) with a wire strain relief housing (26) mounted on a rear end (8) of the connector housing (6). The strain relief housing (26) includes a base (28) with a transverse wall (40) and with ribs (42) and (44) extending perpendicular to the transverse wall (40). Ribs (46) and (48) extend parallel to and are spaced to the rear of the transverse wall (40). Wires (80) attached to terminals (4) in the housing (6) extend over the transverse wall (40) so that the transverse wall (40) isolates the terminals (4) or dampens vibrations from being transmitted from the wires (80) to the terminals (4). The wires (80) can then be dressed in any of three directions and a cable tie (76) secured around the wires (80) and a corresponding rib in alignment with one of three openings so that the wires (80) can exit in one of three directions. A hinged cover (56) can then be closed on top of the wires (80).

18 Claims, 3 Drawing Sheets

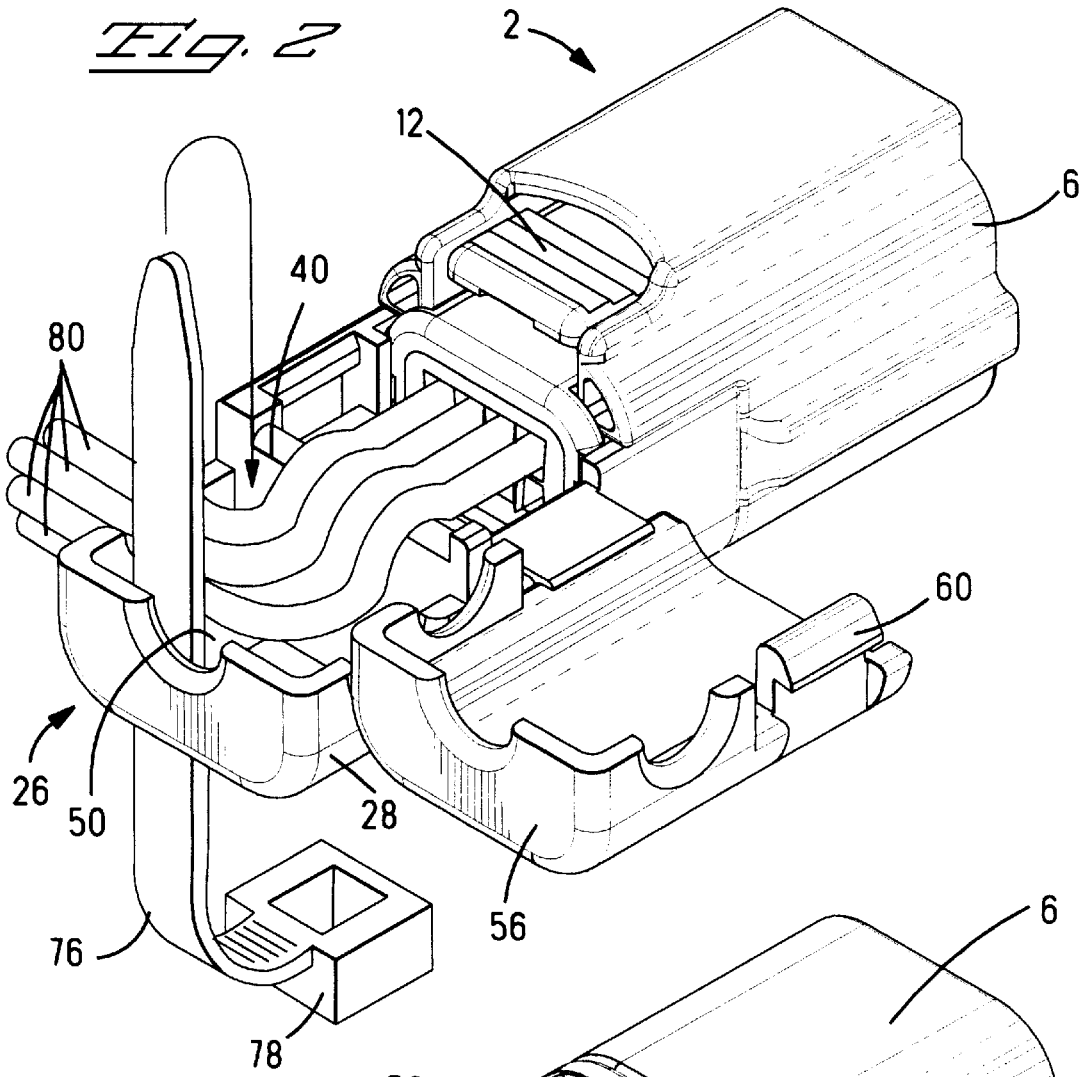
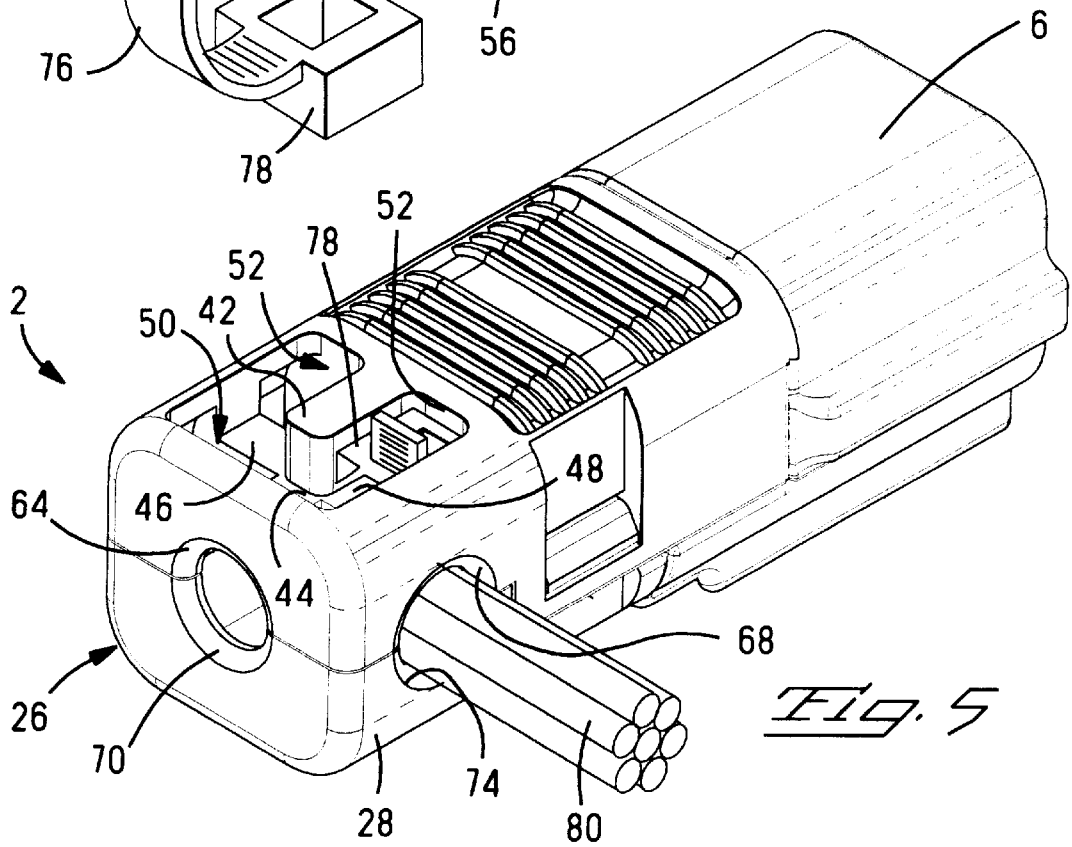
Fig. 5

MULTI-EXIT STRAIN RELIEF FOR AN ELECTRICAL CONNECTOR

BACKGROUND OF THE INVENTION

1. Field of the Invention

This invention is related to electrical connectors and to strain reliefs for securing wires to the connector housing and preventing forces or vibrations on the wires from damaging the terminals or the contact interface between mating terminals.

2. Description of the Prior Art

Strain reliefs are commonly employed on electrical connectors to prevent damage to terminals and the contact interface between mating terminals. The simplest form of damage to terminals is the potential damage to a wire termination due to tension applied to the wire. A crimped termination can be damaged in this way and even if the damage is not visually noticeable, the gas tight connection between a terminal and a wire can be adversely affected. Oxides can form and eventually the contact between the terminal and the wire can deteriorate causing an increase in contact resistance and potentially even an open circuit, especially where tension is repeatedly applied to the termination.

Even where there is no physical damage to the termination between the wire and the contact terminal, vibration transmitted through the wires to the terminals can cause the mating interface between spring loaded mating contact terminals to be unstable or to degrade over time. Vibration can cause the contact point between mating terminals to shift slightly from a point where good metal to metal contact is obtained to a location where oxides have built up. Fretting corrosion can also result. For these and other reasons it is important that a strain relief be provided to isolate external forces from terminals and terminations.

Conventional strain reliefs are located on the rear of electrical connectors. In different applications the same connector may be used in some applications where the wires should exit to the side while in other applications the wires may exit to the rear of the connector. Therefore some conventional electrical connector strain reliefs have provided means for securing wires to the stain relief in at least three orientations. U.S. Pat. No. 4,080,035 is one example of an electrical connector in which cable ties can be used to secure wires to the strain relief.

U.S. Pat. No. 5,211,706 is another example of a prior art connector in which the wires can exit either to one side of the strain relief or through the rear of the strain relief housing. That strain relief comprises a top and bottom housing with one molded cable tie loop on the bottom half and another on the top half. For applications in which the wire is to exit through the rear a cable tie is inserted around the wires through the loop in the top housing half. For side entry applications, the cable tie is inserted through a loop adjacent the side of the bottom half.

A common problem with these and other prior art multi-exit strain reliefs is the relative size of the strain relief. In some cases, the strain relief occupies as much space as the connector itself. The strain relief may be wider than the connector or it can be longer than the connector. In each case large strain reliefs cannot be used in applications where space is at a premium, which is generally the case where side exit connectors are used.

SUMMARY OF THE INVENTION

The instant invention provides a strain relief that not only permits the wires to be secured with a conventional cable tie, but also provides a surface, in the form of a transverse wall, over which the wires may be formed to limit or dampen the vibration that would otherwise be transferred to the terminals or to the contact interface. For this reason alone, this connector can be used in applications, such as automotive applications, in which vibration is a significant problem. Strain relief can also be achieved in this connector by using a strain relief housing that is no wider than the connector itself and in which the length of the strain relief can be approximately the same as the length of the connector housing. This connector also permits the wires to exit in either of three directions and uses the same vibration damping transverse wall regardless of the direction in which the wires exit the connector. The strain relief housing also comprises a single one piece molding that can be fabricated without side pulls so that it can be inexpensively molded. Furthermore the wires may be attached to the strain relief housing and the strain relief housing can be mounted on the connector without the use of screws or added components other than a single conventional cable or wire tie.

The electrical connector including this strain relief includes a connector housing and a strain relief housing. A transverse wall can extend from the bottom of the strain relief housing so that wires extending from the rear of the connector housing extend across the transverse wall so that vibration is dampened by the transverse wall. The wires can then be dressed to either side or can extend straight through the rear of the strain relief housing. Ribs extend in each of the three directions on the rear of the transverse wall and a cable tie can be wrapped around the wires and a corresponding rib.

In the preferred embodiment, the strain relief includes a hinged cover. The ribs are on the strain relief base to which the cover is latched. The ribs can be formed in a crucifix or cross configuration with slots on either side of all of the ribs so that the cable tie can be wrapped around any rib. On the bottom of the strain relief housing, the ribs are recessed to provide clearance for a conventional cable tie clasp.

BRIEF DESCRIPTION OF THE DRAWINGS

FIG. 2 is a three dimensional view showing the manner in which wires are positioned in the strain relief.

FIG. 5 is a three dimensional view showing the bottom of the electrical connector with the strain relief attached and with wires extending from one side of the strain relief.

DESCRIPTION OF THE PREFERRED EMBODIMENT

Figure 1:
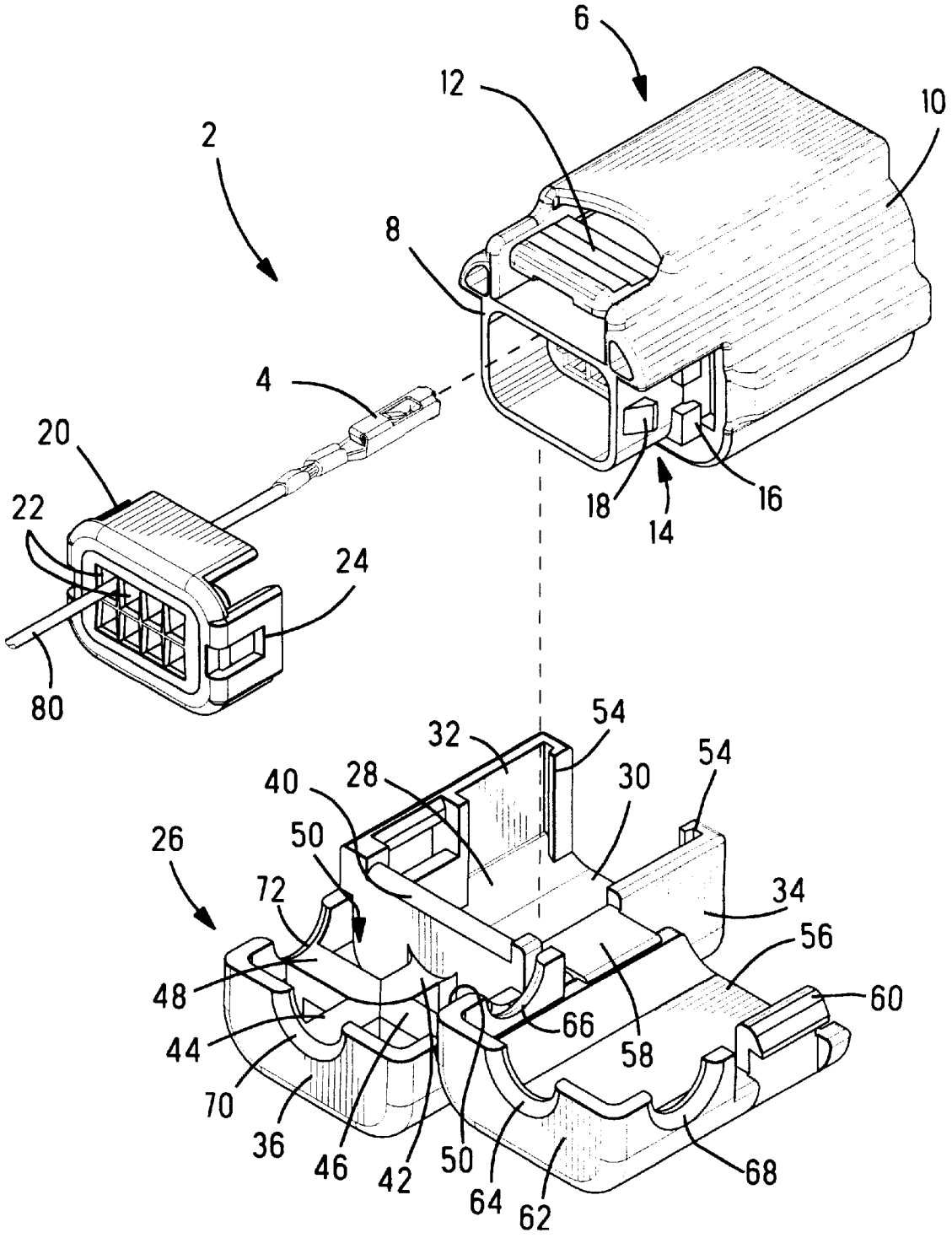
FIG. 1 is an exploded three dimensional view of an electrical connector and a multi-exit strain relief used with that electrical connector.

The electrical connector 2 is used to connect a plurality of wires 80 to a mating electrical connector or header of conventional construction. Multiple terminals 4 are positioned side by side in a connector housing 6. Wires 80 are crimped to the conventional terminals 4, and these wires extend from a rear face or end 8 of the housing 6. The terminals 4 are positioned within cavities in the housing 6 in conventional fashion and these cavities open on a mating face or end 10 so that the terminals 4 are exposed for mating. The multi-exit strain relief 26 is mounted on the rear end 8 of housing 6, and this strain relief 26 isolates the terminals 4 and the mating interface between contacts in the two connectors from forces and vibrations applied to or transmitted through the wires 80.

Connector housing 6 includes a connector latch 12 adjacent the rear end 8, and the latch 12 is accessible on the top of the connector housing 6. An undercut section 14 is located on the opposite side of the rear housing end 8 from the latch 12. This undercut section includes dove tail tabs 16 for mounting or securing strain relief 26 to the housing 6. Seal cap tabs 18 are located on opposite sides between the back of the housing 6 and the dove tail tabs 16. An optional seal cap 20 having side by side holes 22 through which wires 80 extend and through which terminals 4 can be inserted is held in place by molded resilient latches 24 which engage seal cap tabs 18. This seal cap 20 holds a seal (not shown) within a surrounding skirt on the rear of the housing 6.

Figure 3:
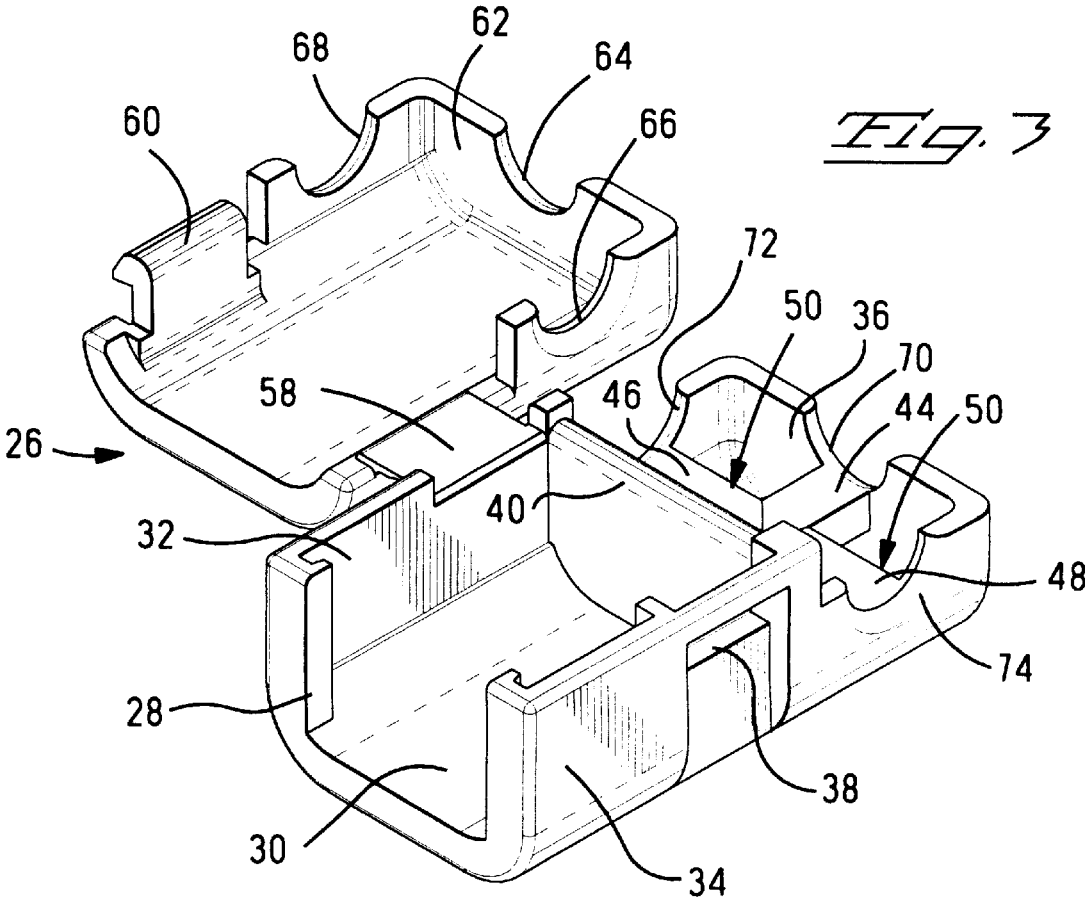
FIG. 3 is a view of the interior surfaces of the strain relief.

The strain relief 26 is an auxiliary housing that can be attached to the rear of the connector housing 6, preferably after the terminals 4 attached to wires 80 have been inserted into the cavities in housing 6. The strain relief housing 26 comprises a molded member including a base 28 and a cover 56 that is attached to the base 28 by an integrally molded or living cover hinge 58. This two part housing is injection molded in the position shown in FIGS. 1 and 3 with the cover 56 in the open position. The strain relief housing 26 is molded from a conventional thermoplastic, such as polypropylene, which is sufficiently flexible to permit the integral cover hinge 58 to be folded.

The base 28 of strain relief housing 26 has a lower surface 30 which forms an exterior surface when the strain relief housing 26 is attached to the connector housing 6. The base 28 also includes a left side wall 32 and a right side wall 34 which extend substantially perpendicular from the edges of the lower surface 30. A rear wall 36 extends between the two side walls at the rear end of the strain relief housing base 28. The opposite end of the strain relief housing base 28 is open with dove tail tongues 54 extending along the adjacent edge of each of the side walls 32 and 34. These dove tail tongues 54 are dimensioned to slide over and receive the tabs 16 on the connector housing 6 when the front portion of the strain relief housing 26 is moved upwardly into the undercut section 14 on the connector housing 6.

A transverse wall 40 extends between the two side walls 32 and 34 intermediate the ends of the strain relief housing base 28. This transverse wall 40 divides the housing base 28 into two chambers, the front chamber being dimensioned to receive the undercut section 14 on the connector housing 6 and the rear chamber providing space for dressing wires 80 so that they can alternatively exit in either of two directions parallel to the transverse wall 40 or perpendicular to the transverse wall 40. The transverse wall 40 extends perpendicular to the lower surface 30 and has a height such that all of the wires 80 extending rearwardly from the terminals 4 can be dressed or laced over the transverse wall 40 as shown in FIG. 2. Positioning the wires 80 over the transverse wall 40 in this manner significantly reduces the effects of vibration, which can be significant in automotive applications in which connector 2 can be used. With the wires 80 formed over the transverse wall 40 as shown in FIG. 2, vibration will not be transmitted through the wires 80 to the terminals 4 and the contact between mating terminals at the mating end will be more stable.

Figure 4:
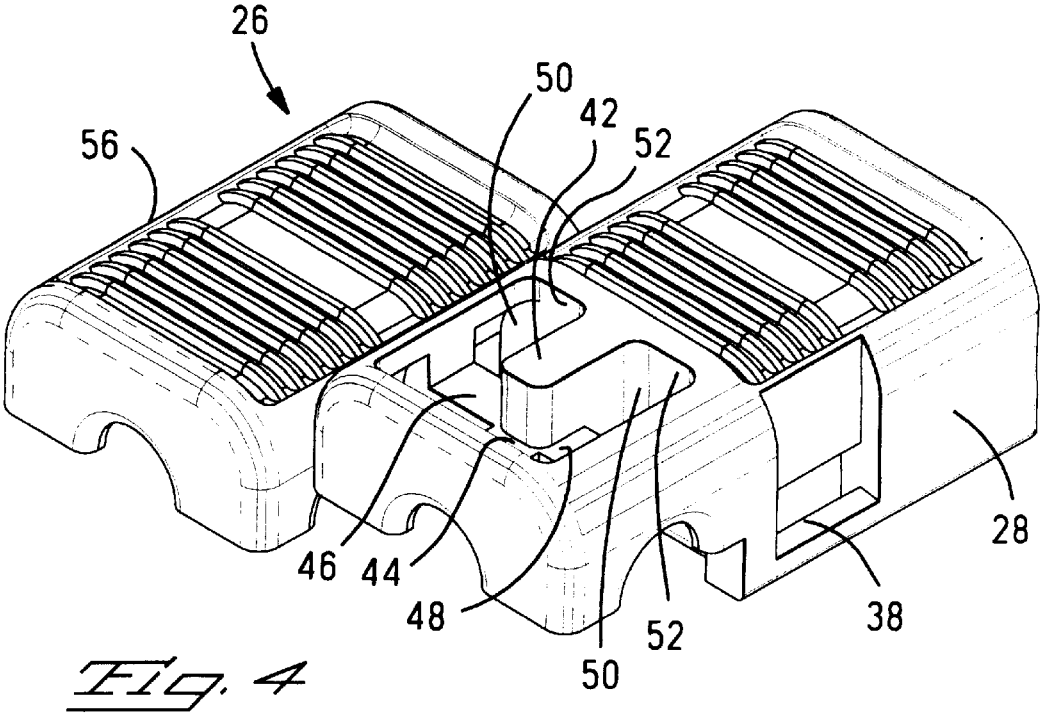
FIG. 4 is a view of the exterior of the strain relief.

The portion of the strain relief housing to the rear of transverse wall 40 provides space for the wires 80 to be dressed in either of three directions and for attachment of a cable tie 76 to secure the wires 80 to the strain relief housing 26. Four ribs 42, 44, 46 and 48 in a cruciform or cross configuration are molded as an integral part of the strain relief housing base 28. The transverse wall 40 is located between the ribs and connector housing 6. A first rib 42 extends from the center of the transverse wall 40 towards the rear of rear housing wall 36. As shown in FIG. 1, the height of rib 42 and the other three ribs is less than the height of the transverse wall 40. A right parallel rib 46 and a left parallel rib 48 are parallel to and spaced from the transverse wall 40. Each of these parallel ribs 46 and 48 extend from the first rib 42 to the adjacent side walls 32 and 34. A perpendicular rib 44 extends from the intersection of the two parallel ribs 46 and 48 and the first rib 42 to intersect the rear wall 36. Ribs 42 and 44 are aligned. Each of the ribs 42, 44, 46, and 48 has a concave upper surface suitable for positioning wires 80 along the tops of the ribs. Four slots 50 are formed between intersecting ribs and adjacent housing side walls, housing rear walls and the transverse wall 40 located between the ends of the strain relief housing base 28. These slots 50 open on the base lower surface 30 so that the slots are open to the exterior to permit insertion of a conventional plastic wire tie or cable tie. As best shown in FIGS. 4 and 5, the perpendicular rib 44 and the two parallel ribs 46 and 48 do not extend to the exterior of the lower base surface 30. Instead recessed sections 52 are formed around the first rib 42 that does extend to the exterior face of lower surface 30. These recessed sections 52 are deep enough so that a conventional cable tie clasp 78 can be positioned in one portion of the recessed section or area 52 as best shown in FIG. 5.

The strain relief cover 56 is shorter than the housing base 28 to which it is joined by the cover hinge 58. The strain relief cover 56 is however long enough to enclose wires 80 extending over the transverse wall 40 and along one of the ribs 44, 46, or 48. The front portion of the cover 56 extends to the rear end 8 of the connector housing 6 and it is recessed from the front end of base 28 by the length of the undercut section 14 on connector housing 6. Cover 56 includes a cover latch 60 extending opposite the cover hinge 58. This latch 60 is dimensioned to engage a latch groove 38 on the exterior of the strain relief base 28 when the cover 56 is folded about the cover hinge 58 to close the upper part of the strain relief housing 26.

The cover 56 has three semicircular openings, a rear opening 64 and two side openings 66 and 68 along the upper edges of the rear cover wall 62 and along the sides of the cover 56. These cover openings are positioned so that they will be opposite three semicircular openings 70, 72, 74 on the rear and side walls of the housing base 28. When the cover 56 is latched in the closed position, three circular openings are formed by these semicircular openings. Ribs 44, 46, and 48 are each aligned with one of the circular openings. Each resultant opening is large enough so that all of the insulated wires 80 can extend through any one opening a shown in FIG. 5. Therefore all of the wires can be dressed to the side, either to the left or right, or can extend from the rear of the strain relief housing 26 perpendicular to the rear end or face 8 of the connector housing 6. However, the circular openings need not be sized to grip the wires. Wire ties 78 secure the wires to the strain relief 26. Therefore, this strain relief is not limited to a specific number of wires or wires of only one size.

Wires 80 and terminals 4 can be assembled to the connector housing 4 and strain relief can be provided in the following manner. If a seal is to be used, the seal is positioned on the rear housing end 8 and secured by the seal cap 20. Terminals 4 are crimped or otherwise attached to the wires 80 and the terminals 4 are inserted into cavities in the housing 6 from the rear. If a seal is used, the terminals are inserted through wire holes 22 in seal cap 20 and then through aligned holes in the seal into the housing cavities. After the terminals 4 have been properly inserted into the housing cavities with the wires 80 extending out beyond the housing end 8, the strain relief housing 26 is assembled to the connector housing 6. The cover 56 is initially in the open position. The dove tail tongues 54 on the front end of the strain relief housing base are fitted over the tabs 16 in the connector housing undercut section 14, and the strain relief housing 26 is slid into place. The wires 80 are then formed or bent over the transverse wall 40 as shown in FIG. 2. A kink or permanent bend is formed in each wire 80 where it crosses the transverse wall 40. This kink or bend, held tightly on the transverse wall 40, helps prevent transfer of vibration to the terminals 4. The wires 80 to the rear of the transfer wall are then dressed in one of three directions so that the wires 80 can exit either to the side or from the rear of the connector 2. FIG. 2 shows the wires extending to the left. After the wires 80 are dressed or bent in this manner, a cable tie 76 is then inserted into one of the slots 50 adjacent the rib along which the wires 80 extend. The flexible wire tie 76 is then wrapped around the wires 80 and the rib along which it extends and is then inserted through a slot 50 on the opposite side of the corresponding rib. The wire tie 76 is then inserted through a wire or cable tie clasp 78 of conventional ratcheting construction and the wire tie 76 is cinched tight. As shown in FIG. 5 the recessed sections 52 on the lower surface of the strain relief housing 26 provide ample room for the cable tie clasp 76 to fit within the profile of the strain relief housing 26. The excess wire tie can then be cut off. Cover 56 is then closed with the cover latch 60 engaging the latch groove 38 as the cover hinge 58 flexes. The wires 80 then extend through one of the openings in alignment with one of the ribs so that the wires 80 can exit the strain relief in one of three directions.

Of course a number of modifications apparent to one of ordinary skill in the art can be made to this preferred embodiment. For instance, a separate cover could be used instead of using a cover attached by the integral flexible cover hinge. In some applications, the cover could be omitted. Also the strain relief could be attached to the connector housing by a number of conventional means. Screws or other fasteners could even be used, although that would complicate assembly. Another option would be to limit the connector to one side opening. However, this would mean that either the connector or the strain relief would have to be flipped for the wires to exit in an opposite direction. The modifications necessary to implement such a single side entry approach would however be apparent to one of ordinary skill in the art. Therefore this invention is not limited to its preferred representative embodiment depicted herein, but is defined by the following claims.

I claim:

1. An electrical connector for use with a plurality of wires, the connector comprising:

a housing with a plurality of terminals mounted in the housing so that wires attached to the terminals extend from one end of the housing; and a wire strain relief attachable to the one end of the connector housing, the strain relief including a body with a transverse wall over which the wires are dressed, and a first rib extending perpendicular to the transverse wall with other ribs extending from the first rib which are parallel to and perpendicular to the transverse wall, the ribs being exposed so that a cable tie surrounding wires exiting either parallel to or perpendicular to the transverse wall can be secured to at least one of the ribs, the transverse wall being located between the connector housing and the ribs.

2. The electrical connector of claim 1 wherein the wire strain relief includes a cover that can be positioned over the wires after the cable tie has been secured to the wires and one rib.

3. The electrical connector of claim 1 wherein the ribs are recessed from a lower surface of the strain relief.

4. The electrical connector of claim 1 wherein slots are formed on opposite sides of each of the ribs.

5. The electrical connector of claim 1 wherein ribs extending parallel to the transverse wall intersect a rib extending perpendicular to the transverse wall.

6. The electrical connector of claim 1 wherein the transverse wall is spaced from a rear face of the electrical connector housing.

7. The electrical connector of claim 2 wherein the ribs and the transverse wall comprise portions of a strain relief base, the cover being securable to the base and over the wires.

8. The electrical connector of claim 3 wherein the cover is hinged to the base.

9. The electrical connector of claim 6 further including a seal cap mounted on the rear face of the housing, the seal cap being positioned between the connector housing and the transverse wall.

10. An electrical connector for use with a plurality of wires, the connector comprising:

a housing with a plurality of terminals mounted in the housing so that wires attached to the terminals extend from one end of the housing;

a wire strain relief comprising a base including means to attach the wire strain relief to the one end of the housing;

mutually perpendicular intersecting ribs extending upward on the base, wherein each rib is perpendicular to an exterior surface of the base; and slots formed on each side of the mutually perpendicular ribs and extending through the base so that a cable tie can be secured in surrounding relationship to each rib and to wires positioned on the corresponding rib, whereby wires can extend in three directions from the electrical connector.

11. The electrical connector of claim 10 wherein the wire strain relief includes a cover attachable to the base.

12. The electrical connector of claim 10 wherein the ribs are recessed from an exterior surface of the base to provide clearance for a wire tie clasp.

13. The electrical connector of claim 11 wherein the cover is hinged to the base.

14. The electrical connector of claim 11 wherein the base and cover each include openings aligned with the ribs so that the wires may exit the wire strain relief.

15. An electrical connector for use with a plurality of wires, the connector comprising:

a housing with a plurality of terminals mounted in the housing so that wires attached to the terminals extend from one end of the housing;

a cable tie surrounding the wires at the one end of the housing; and an auxiliary housing attachable to the one end of the housing, the cable tie being attached to the auxiliary housing, the housing including a first member having cruciform ribs with the cable tie surrounding the wires and a corresponding rib, the cruciform ribs being oriented so that the ribs are either perpendicular or parallel to the one end of the housing so that wires secured by the cable tie can extend either perpendicular or parallel to the one end of the housing.

16. The electrical connector of claim 15 further including an auxiliary housing cover attachable to the first member and removable to permit access for securing the cable tie around the wires and a corresponding rib.

17. The electrical connector of claim 15 further comprising a transverse wall on the auxiliary housing between the cable tie and the connector housing so that wires extending from the connector housing extend across the transverse wall to reduce the effects of vibration.

18. The electrical connector of claim 15 wherein the first auxiliary housing member includes recessed sections on an outer face thereof, a cable tie clasp being received in one of the recessed sections.

* * * * *